US005397132A

United States Patent [19]

Maryska

[11] Patent Number: 5,397,132

[45] Date of Patent: Mar. 14, 1995

[54] TARGET FOR SHOOTING

[75] Inventor: Walter L. Maryska, Harbord, Australia

[73] Assignee: Riteflite Pty Limited A.C.N., New South Wales, Australia

[21] Appl. No.: 238,274

[22] Filed: May 4, 1994

Related U.S. Application Data

[63] Continuation of Ser. No. 88,820, Jul. 8, 1993, abandoned.

[30] Foreign Application Priority Data

Nov. 20, 1992 [AU] Australia ..... 28517/92

[51] Int. Cl.[6] ..... F41J 9/16

[52] U.S. Cl. ..... 273/363

[58] Field of Search ..... 273/362, 363, 378, 364, 273/365, 380

[56] References Cited

U.S. PATENT DOCUMENTS

| | | | |
|---|---|---|---|
| 960,359 | 6/1910 | Lord | 273/362 |
| 4,802,676 | 2/1989 | Descos et al. | 273/363 |
| 4,921,250 | 5/1990 | Ayres | 273/378 |

FOREIGN PATENT DOCUMENTS

| | | |
|---|---|---|
| 253448 | 7/1964 | Australia . |
| 1151376 | 6/1976 | Australia . |

*Primary Examiner*—Mark S. Graham

*Attorney, Agent, or Firm*—Allegretti & Witcoff, Ltd.

[57] ABSTRACT

A target for shooting is provided of a substantially circular formation, having an inner body portion formed of a gypsum composition, with an outer coating or skin. The target has a medial portion which extends into an outwardly and downwardly curving side skirt. One or more raised portions are provided on an outer surface of the skirt, at least one raised portion being positioned on an upper portion of the skirt, at or adjacent an area where said skirt is of a lesser or reduced thickness.

6 Claims, 3 Drawing Sheets

TARGET FOR SHOOTING

RELATED APPLICATION

This application is a continuation of application Ser. No. 08/088,820, filed Jul. 8, 1993, now abandoned.

BACKGROUND OF THE INVENTION

This invention relates to a target and in particular to a target for use in clay target shooting or skeet shooting. Such targets are however able to be used in trap, field and game, and olympic trench and I.S.U. shooting. Such shooting is an internationally recognised and very popular sport. Up until this time various targets have been manufactured and sold. However there have been many problems associated with such targets.

It should be appreciated that in clay target shooting or skeet shooting the target is catapulted or shot out of an appropriate mechanism at a substantial speed, to be shot by a shooter. On the target being shot or hit, it is desirable that the target disintegrate and fall to the ground. The catapulting or firing of the target out of the appropriate mechanism, places substantial stress and strain on the target. Up until this time many targets have been manufactured from what might be considered to be environmentally unfriendly material, such as for example tar, pitch, limestone and the like. As indicated above, when a target is shot at and hit, it disintegrates or breaks up into many particles, which fall to the ground. When such targets are manufactured of environmentally unfriendly material, such as tar or pitch, that material can cause damage to the ground onto which the shattered target falls. Further, animals, insects and the like in the area might consume such material which could lead to disease.

Further, known and currently used targets are not always as effective in use as might be desired.

It is an object of at least one aspect of the present invention to go at least some way towards overcoming and/or minimising the problems associated with targets known and used up until this time.

Other objects of the present invention will become apparent from the following description.

SUMMARY OF THE PRESENT INVENTION

According to one aspect of this invention there is provided a target formed of a substantially circular formation, having an inner body portion in the form of a particulate gypsum composition; an outer upper surface of said target having a medial portion extending into an outwardly and downwardly curving side skirt; an outer coating or skin extending about, so as to encapsulate, said inner particulate body portion; said outer coating or skin being of a different material from, and being harder and brittle relative to, the particulate gypsum composition of said inner body portion.

According to a further aspect of this invention there is provided a target formed of a substantially circular formation having a medial portion extending into an outwardly and downwardly curving side skirt; one or more raised portions extending upwardly from an outer surface of said skirt, and being positioned on an upper area of said skirt, adjacent said medial portion; wherein said skirt is of a reduced thickness at or adjacent the location of one or more of said raised portion(s).

BRIEF DESCRIPTION OF THE DRAWINGS

This invention will now be described by way of example only and with reference to the accompanying drawings, wherein.

DETAILED DESCRIPTION OF PREFERRED EMBODIMENTS OF THE INVENTION

Figure 1:
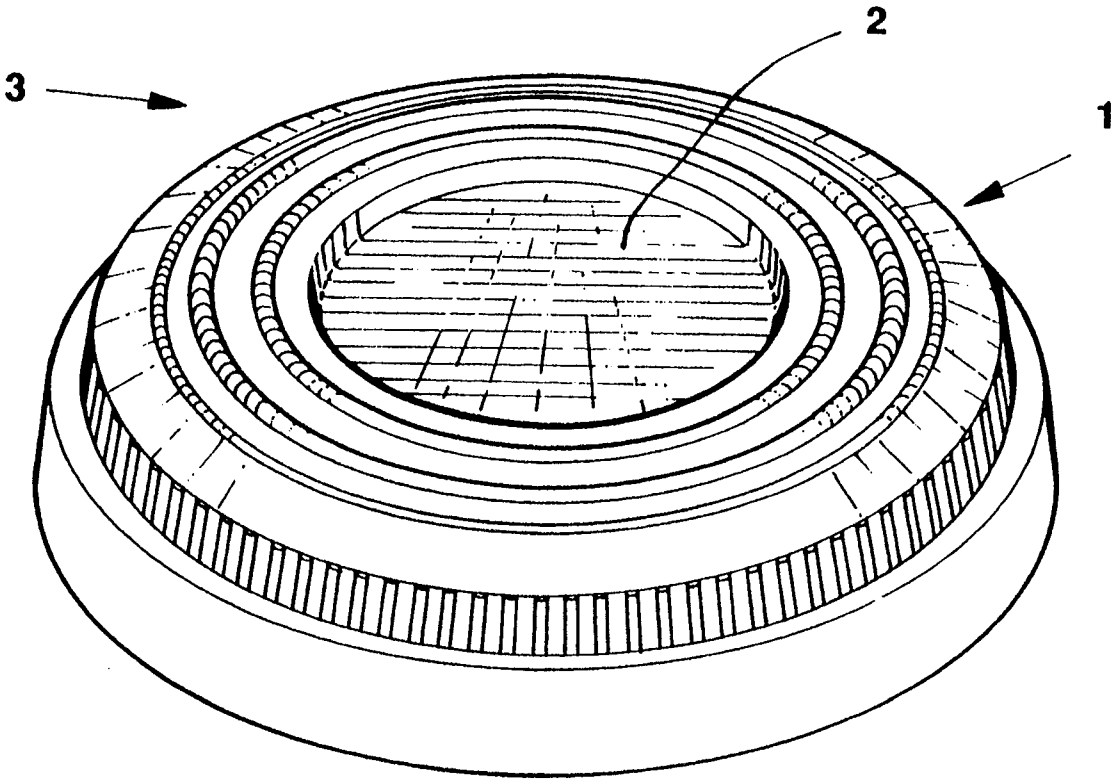
FIG. 1 is a perspective view of a target according to one form of the present invention.

As referred to hereinbefore, it has been common up until this time to manufacture targets of environmentally unfriendly material and in particular tar, pitch and the like. When such materials are hit by pellets or bullets during clay target shooting or skeet shooting, the targets break up and disintegrate falling to earth. The use of such material is environmentally unfriendly and has a particularly adverse effect on the environment. Further, it can poison animals which come into contact therewith. Further, the targets used up until this time have not been as effective as possible, especially bearing in mind that they must be catapulted or shot out of appropriate mechanisms at a substantial speed.

The present invention sets out to overcome or minimise these problems by providing a target which has a body formed substantially of a gypsum composition, with an outer, thin coating or skin, as will be described hereinafter. It has been found that the use of such a coating or skin, is particularly advantageous in that, without such a skin, the gypsum composition forming the main body portion or inner core of the target of the present invention might well disintegrate or break up with the force of being shot or catapulted out of the appropriate mechanism. The use of an outer skin or shell holds and binds the gypsum composition into a target of the desired shape and configuration.

The use of a gypsum composition has been found to be particularly advantageous, especially from an environmental point of view. Thus, following the target being shot and breaking up and disintegrating, the particles will fall to earth and can be used for example as soil conditioners, at the same time as being used to decrease the acidity of the soil. Certainly, the gypsum materials when disintegrated and having fallen to earth, does not have the substantial disadvantages from an environmental point of view, as are associated with many materials used in the manufacture of previous targets. The target of the present invention also provides a particular configuration to enable the target to be easily shattered on being hit by a pellet or bullet.

Various features of the target of the present invention are illustrated by way of example only, with reference to the accompanying drawings. These will be described hereinafter.

In forming the target of the present invention however, a gypsum composition is prepared and moulded into the shape desired. The gypsum composition preferably includes an admixture of CASO42H20 (true gypsum), CASO4 (dehydrated gypsum) and CASO4 $\frac{1}{2}$ H20 (hemihydrate gypsum).

The gypsum is bound or mixed together preferably first as a dry mix, then as a wet mix, and the hemihydrate gypsum acts as an active plaster, or calcined gypsum to bind the composition together.

In preparing an appropriate mixture for moulding the targets of the present invention and by way of example only, the gypsums referred to above are mixed together with, for example, hydrated lime, bentonite and colouring (for example black iron oxide for a black target or whiting for a white target). If desired, any colouring or pigment can be used, subject to such pigment or colouring being compatible with the base mixture.

These ingredients are dry-blended and mixed, such as by a paddle mixer or ribbon blender.

Thereafter the constituent parts are wet-mixed, such as for example in a vacuum wet mix chamber, which allows for water to be added in an appropriate manner and for the addition for example of acceleration ingredients, such as for example sodium sulphate, ammonium sulphate, potassium sulphate and sodium chloride.

If desired, additives such as liquid soap, macromil starch or an appropriate polymer can be added to the admixture to assist with the flowability thereof for the purposes of moulding. In addition, if desired, additives such as kerosene, diesel or the like can be added to assist releasing the discs from the mould. These are, however, by way of example only.

After a wet mix for a predetermined period of time, the mixture is passed or dispersed into moulds, such as by an appropriate pump or other means. The mould is then closed for a predetermined period of time.

Appropriate means can then be provided to eject the articles from the mould and to be transferred to an appropriate drying means. The targets for example will travel through a dryer on an appropriate conveyer, the dryer being designed to remove all moisture. Any appropriate form of dryer can be used, such as for example an electric dryer, gas dryer or microwave.

Having been removed from the dryer, and still retaining heat, the targets are coated with a sealant, either by being dipped in a bath or by being coated or sprayed with the sealant. The sealant is preferably a cold sealant which when dried is preferably non-UV-light-resistant, brittle and waterproof, such as to dry and form a coating or shell about the main gypsum body portion. By way of example, in one form of the invention, the sealant is an alcohol based natural cellulose gum sealant. The sealant is preferably applied to the moulded and dried discs, while they still retain heat (preferably in the region of 40° C.–50° C.). Thus, by so spraying or coating the moulded discs with a sealant at that point in time, the cold sealant incorporating alcohol, will go to the surface of the targets to form an outer sealant coating or skin, which is relatively brittle. This outer shell then acts as a binder, holding the dried body portion of essentially particulate and powdered calcium material therewithin. The outer shell is allowed to dry and form about the moulded targets and during such time and during for example packaging, the alcohol will evaporate. Thus, when the target comes to be used and is ejected out of appropriate mechanisms at high speed and velocity, the outer shell will hold the target together, whereas without the outer coating or shell, the moulded calcium material might disintegrate.

It is envisaged that in the preferred forms of the invention, the coating or skin of the target will be of micron dimensions and thickness, such as for example approximately 0.4 mm. This is by way of example only however.

Referring now to the accompanying drawings, the target 1 is of a substantially circular formation, having a recessed central or medial portion 2 which has a substantially flat or planar upper surface and which is then stepped up into a skirt 3 which then extends outwardly and curves downwardly from the central or medial portion 2. The target has a main body portion 21, formed of a gypsum composition, and an outer coating or skin 20, extending thereabout.

The invention is of course described with reference to the accompanying drawings, but it should be appreciated that in preferred forms of the invention, the outer upper surface of the skirt 3 is provided with one or more raised portions. While these will be described with reference to the drawings, as being annular ribs, it should be appreciated that any form of raised portions can be used. For example, spaced apart elongate strips, dimples or the like. It is however important that one or more of the raised portions be located at or adjacent an area 10 of the skirt 3, which is of a lesser or reduced thickness. Further, in preferred forms of the invention, where a plurality of raised portions are provided, at least one of the raised portions is of a greater height than the others, and to that extent extends upwardly from the outer surface of the skirt, to a greater extent than the other raised portions. It is further preferred that the one or more raised portion of greater height be located at or adjacent the area 10 of the skirt 3; that is the area of a lesser or reduced thickness. In one preferred form of the invention, that is described with reference to the accompanying drawings, the raised portions of the present invention are in the form of a plurality of spaced apart annular ribs. It should be appreciated however that if desired, only one rib need be provided, and that such a rib could be located at or adjacent the area 10 of reduced thickness of the skirt 3.

In said preferred form of the invention the upper portion of the skirt 3 is provided with a plurality of spaced apart annular ribs 4. At least one of these ribs **4*a* is higher than the others (extends upwardly for a greater distance from the outer surface 3*a* of the skirt than the others). In the preferred form of the invention the higher rib 4*a* will be located either immediately adjacent the juncture between the recessed medial portion and the skirt, or outwardly thereof. As will be appreciated from the following description however, it is important that the rib 4*a* of greater height be located adjacent that area 10 of the skirt 3** that is of a lesser thickness. This will be described further hereinafter.

Any number of other ribs can be provided on the skirt, as may be desired.

The thickness of the skirt of the target, adjacent the location of the rib **4*a* of greater height is of a lesser or reduced thickness, relative to the thickness of the remainder of the skirt 3**.

Figure 3:
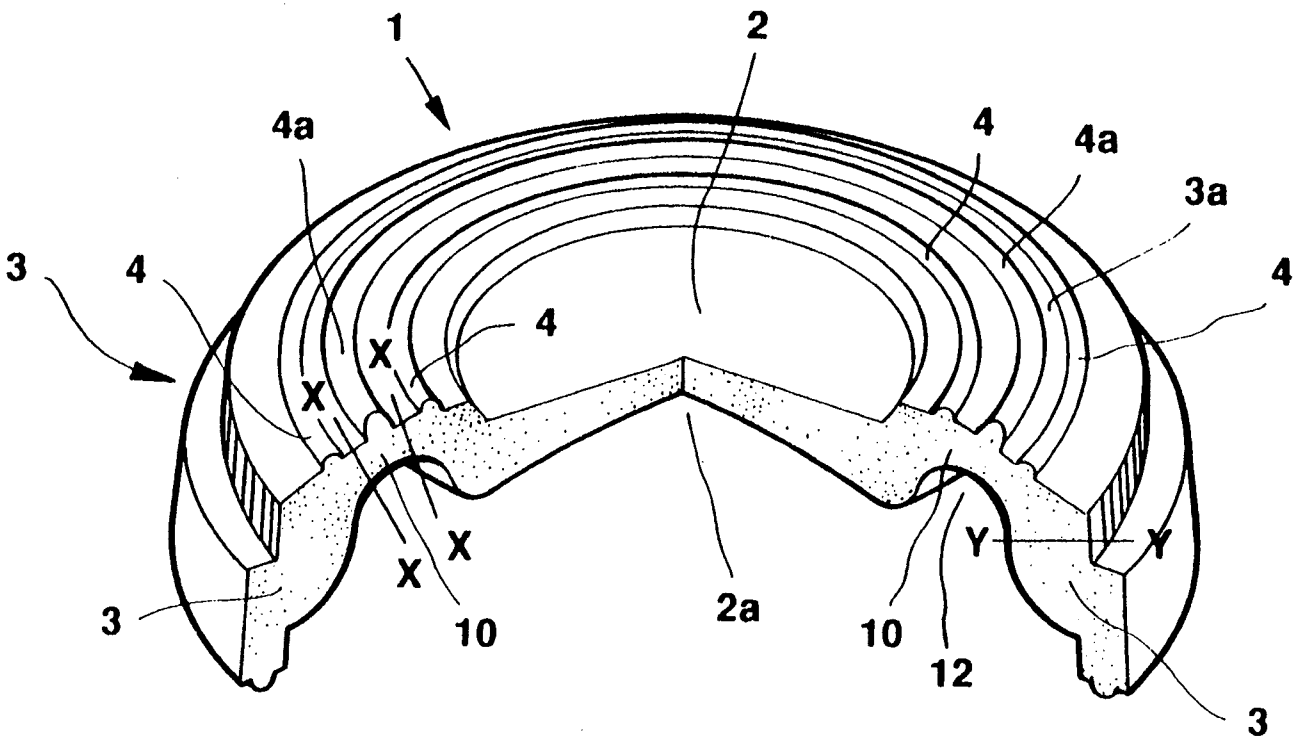
FIG. 3 is a cross-sectional view of a target according to one form of the present invention.

By way of example only and referring to FIG. 3 of the accompanying drawings, the thickness of the rib along lines X—X adjacent the rib of greater height, is in the range of for example 3 mm–3.5 mm, whereas the thickness of the skirt at position Y—Y is in the region of 8 mm.

It has been found that by providing one rib 4a of a greater height than the others, pellets or shots aimed at the target 1, will hit the rib **4*a* of greater height and will be deflected therefrom onto the skirt 3 at an area of lesser or reduced thickness, thus causing the pellet to disintegrate the skirt and target. There are therefore substantial advantages in providing the target with a rib 4*a* of greater height at or adjacent that area of the target which is of a lesser or reduced thickness than the skirt 3**.

It should be appreciated that while the invention has been described with reference to the target being provided with ribs 4 and a higher rib 4*a*, the same advantages of the invention apply where other raised portions are provided extending upwardly from an outer surface 3*a* of the skirt 3.

Figure 2:
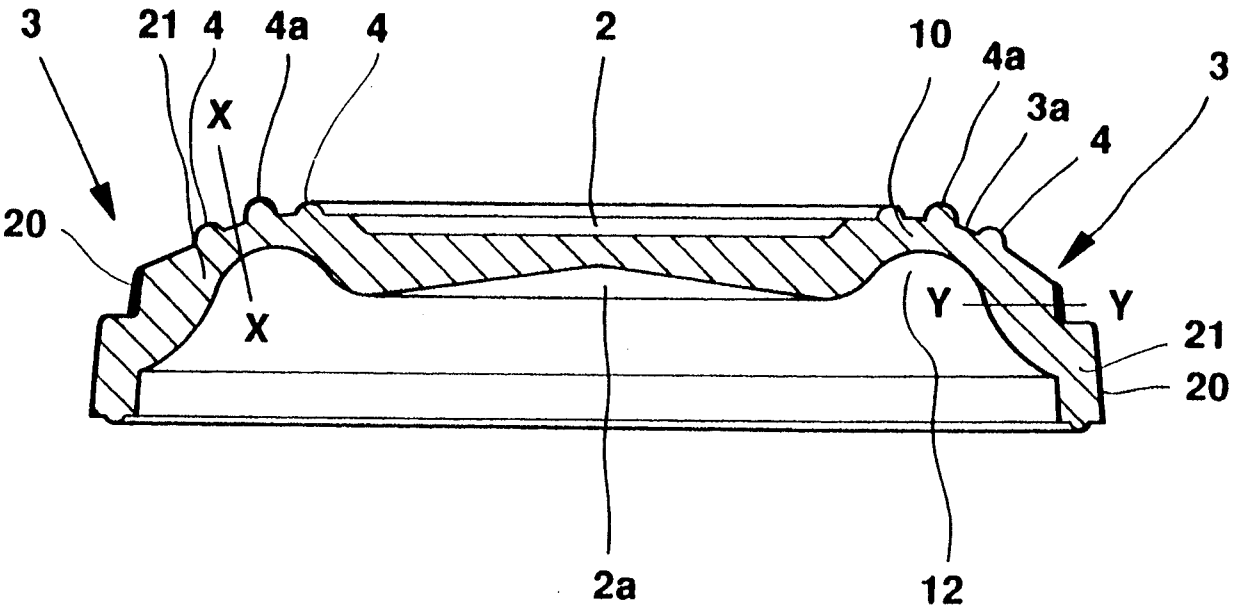
FIG. 2 is a sectional perspective view of a target according to one form of the present invention.

Referring further to the accompanying drawings and in particular to FIGS. 2 and 3 thereof, it will be appreciated that the underside of the target is moulded and formed so that an annular recess 12 extends about the under or lower surface of the target, about the underside of the groove or area defining the medial portion 2, and essentially immediately underneath the substantial juncture between the medial portion 2 and the upper portion of the skirt 3. This recess 12 allows for the provision of an area 10 of lesser thickness at or adjacent the approximate location of the rib 4*a* of greater height, and also provides a recess or pocket to assist in holding the target in flight (once it is catapulted or fired out of the appropriate mechanisms).

The underside of the medial portion 2 is also provided with a recess or indent 2*a* which forms an additional pocket on the underside of the target. This also has additional advantages in assisting in holding the target in flight. In addition, that recess or indent 2*a* serves to decrease the thickness of the target towards the centre of the medial portion 2 thereof, so that if such an area is hit by pellets or bullets, it will more easily disintegrate.

It should be appreciated that the thickness of the skin, coating or shell 20 is of micron proportions and preferably for example in the range of 0.4 mm. This, compared with the other dimensions of the target 1, as referred to by example hereinbefore, will enable the coating or skin 20 to hold and bind the target together, while at the same time being able to be easily penetrated by pellets or bullets to enable the shattering of the target.

The present invention therefore provides a target which, when shattered, does not present the environmental problems associated with targets used up until this time. The target of the present invention also has the above features which provide a target which has features which enable it to meet the demands of the sport in an efficient and straightforward manner.

This invention has been described by way of example only, and improvements and modifications may be made thereto without departing from the scope of the invention as defined by the appended claims.

I claim:

1. A unitary target integrally formed of a substantially circular formation having an inner body portion formed of a free particulate gypsum composition and being completely coated and encapsulated by a sealant forming an outer skin of said target; an outer upper surface of said target having a medial portion extending into an outwardly and downwardly curving side skirt; said inner body portion of free particulate gypsum composition being completely encapsulated without binding additive, within said outer skin formed of a material which is environmentally friendly and which is different from and harder and brittle relative to, the free particulate gypsum composition of the inner body portion, a plurality of raised portions being provided extending upwardly from the outer upper surface of the outer skin, to be positioned on a upper area of said skirt adjacent to but spaced apart outwardly from said medial portion; at least one of said raised portions extending outwardly from said outer upper surface of the outer skin for a greater distance than the other(s), and wherein said skirt is of a reduced thickness at or adjacent the location of said at least one raised portion.

2. A target, as claimed in claim 1, wherein said area of reduced thickness comprises an annular groove or recess extending about an underside of said target, generally about an area defining an underside of said medial portion thereof; said annular groove or recess forming an annular pocket on said underside of said target.

3. A target as claimed in claim 1 wherein the plurality of raised portions are in the form of a plurality of spaced apart annular ribs.

4. A unitary target integrally formed of a substantially circular formation having an inner body portion formed of an environmentally friendly material and being encapsulated by an outer skin formed of an environmentally friendly material, an outer upper surface of said target having a medial portion extending into an outwardly and downwardly curving side skin, said inner body portion being completely encapsulated within said outer skin without binding additive, said material of said outer skin being different from and harder and brittle relative to the material of the inner body portion, a plurality of spaced apart raised portions extending upwardly from the outer upper surface, at least one raised portion extending outwardly from the outer upper surface a greater distance than the other(s), said skirt being of a reduced thickness at or adjacent the location of said least one outwardly extending raised portion, whereby a pellet or bullet contacting a target in flight will come into contact with said at least one raised portion to be deflected into the skin area of reduced thickness and to thereby cause disintegration of said target.

5. A target as claimed in claim 4 wherein said inner body portion is formed of a powder gypsum composition.

6. A unitary target as claimed in claim 4, wherein the raised portions are in the form of a plurality of spaced apart annular ribs.

* * * * *